US005634857A

United States Patent [19]

Bradshaw et al.

[11] Patent Number: 5,634,857

[45] Date of Patent: Jun. 3, 1997

[54] GOLF CLUB HAVING ANGULARLY ADJUSTABLE SHAFT

[76] Inventors: Richard L. Bradshaw, 18911 Edinborough Way, Tampa, Fla. 33647; Robert M. Bryan, 4469 Vieux Carre Cir., Tampa, Fla. 33613; John Thorniley, 3277 E. Dorchester, Palm Harbor, Fla. 34684

[21] Appl. No.: 645,358

[22] Filed: May 13, 1996

[51] Int. Cl.[6] ..... A63B 69/36

[52] U.S. Cl. ..... 473/238; 473/232; 473/245; 403/157; 403/158; 403/161

[58] Field of Search ..... 473/231, 232, 473/238, 239, 245, 246, 247; 403/157, 158, 161

[56] References Cited

U.S. PATENT DOCUMENTS

| | | | |
|---|---|---|---|
| 1,137,457 | 4/1915 | Breitenbaugh | 473/245 |
| 1,529,305 | 3/1925 | Gatke . | |
| 3,180,308 | 4/1965 | Carroll . | |
| 3,341,203 | 9/1967 | Brill . | |
| 3,663,019 | 5/1972 | Palotsee . | |
| 3,931,969 | 1/1976 | Townhill . | |
| 4,856,782 | 8/1989 | Cannan | 473/232 |
| 5,228,689 | 7/1993 | Donofrio, Sr. . | |
| 5,277,427 | 1/1994 | Bryan et al. . | |
| 5,489,100 | 2/1996 | Potter . | |

*Primary Examiner*—George J. Marlo
*Attorney, Agent, or Firm*—Joseph C. Mason, Jr.; Louise A. Foutch; Mason & Associates PA

[57] ABSTRACT

The proximal and distal parts of a golf club shaft that has been cut into two parts are pivotally interconnected to one another and are releasably lockable into any one of a plurality of different positions of angular adjustment by a device having a proximal end and a distal end that are interlockable to one another. The proximal end of the device includes a sleeve that nonreleasably receives the proximal end of the golf club shaft and the distal end of the device includes a sleeve that nonreleasably receives the distal end of the shaft. The device includes a middle part having a first face plate formed by the proximal end of the device and a second face plate formed by the distal end of the device. Radially disposed teeth formed in respective inner surfaces of the first and second face plates enable relative positioning of the face plates in multiple angular relations, and a projection formed on one of the face plates is received within a recess formed adjacent the other face plate and acts as a pointer that indicates a particular setting by pointing at an indicia imprinted adjacent the recess. Successive positions deloft the clubhead face and teach a user how to select irons and how to hold the hands and wrists when chipping and pitching.

7 Claims, 5 Drawing Sheets

GOLF CLUB HAVING ANGULARLY ADJUSTABLE SHAFT

BACKGROUND OF THE INVENTION

1. Field of the invention

This invention relates, generally, to training aides that help golfers improve their game. More particularly, it relates to a device that creates a preselected angle in a golf club shaft.

2. Description of the prior art

The "short" game of golf includes chipping and pitching, i.e., those shots that typically employ a sand wedge, a nine iron, a seven iron, a five iron, and a three iron.

When a good chip shot is executed, the hands and wrists of the golfer are positioned forwardly of the ball at the time of impact, i.e., between the ball and the target. However, many golfers fail to maintain such hand and wrist position when chipping and pitching, and there are no known training clubs available to teach such positioning.

Moreover, many golfers are unsure as to which club should be employed in a given short game situation.

The conventional wisdom is that chipping and pitching can be learned only through experience. Unfortunately, due to the lack of any good training clubs, many golfers never learn how to master such shots. What is needed, then, is a golf club that teaches golfers how to keep their hands and wrists in front of the ball during chipping and pitching. There is also a need for a golf club that teaches golfers which club would be best in any given short game situation.

However, in view of the art at the time the present invention was made, it was not obvious to those of ordinary skill in this art how the needed training aid could be provided.

SUMMARY OF THE INVENTION

The longstanding but heretofore unfulfilled need for an apparatus that overcomes the limitations of the prior art is now met by a new, useful, and nonobvious invention. The present invention includes a device that is installed by cutting a golf club shaft a predetermined number of inches above the hosel that receives the distal end of the shaft. The cut divides the shaft into a proximal part and a distal part. The device includes a first hosel that receives the distal end of the proximal part of the shaft and a second hosel that receives the proximal end of the distal part of the shaft. The first and second hosels are integral with first and second face plates that are centrally apertured to receive a fastening means that joins the two parts of the device to one another. Teeth are formed in an interior surface of each face plate and the pitch of the teeth determines the amount of angular displacement between each setting of the device.

Thus, the longitudinal axis of the proximal part of the shaft and the longitudinal axis of the distal part of the shaft can be placed into various angular relations to one another. As the angle between them is increased in increments determined by the pitch of the teeth formed in the face plates, the effect is to deloft the striking face of the club head. Thus, where a 64° sand wedge is used, placing the device in a first setting delofts the striking face by the pitch of the teeth. Thus, if the pitch of the teeth is 8°, the first position delofts the striking face to 56°, and so on. The angle positions the club head away from the ball so that the golfer's wrist and hands will be in the correct position at the moment the ball is struck. Using the novel device with the various delofted settings for the club head also teaches the golfer which club should be used in various short game situations.

It is therefore understood that a primary object of this invention to provide a golf club training aid that improves the short game of its users.

A more specific object is to provide a training aid that teaches a golfer how to keep his or her hands and wrists in front of the ball at the time the ball is addressed.

Another object is to provide a training aid that teaches a golfer which club should be used in various short game situations.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
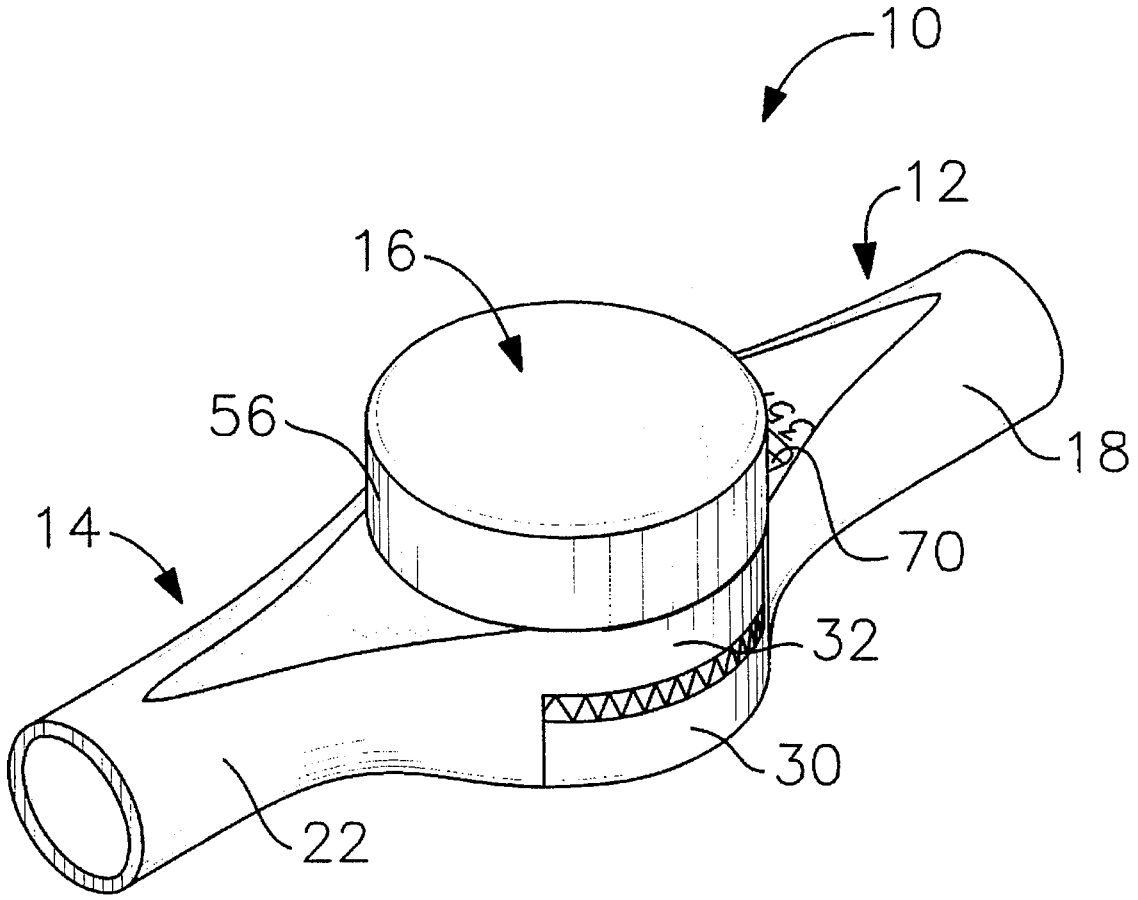
FIG. 1 is a perspective view of an illustrative embodiment of the invention.

Referring now to FIG. 1, it will there be seen that an exemplary embodiment of the invention is denoted as a whole by the reference numeral 10.

Device 10, to be known commercially under the trademark Angle Iron, has a proximal part 12, a distal part 14, and a middle part 16 disposed therebetween. However, as will become clear as this description proceeds, middle part 16 is formed primarily by interlocking parts that are integral with said proximal and distal parts.

Figure 5:
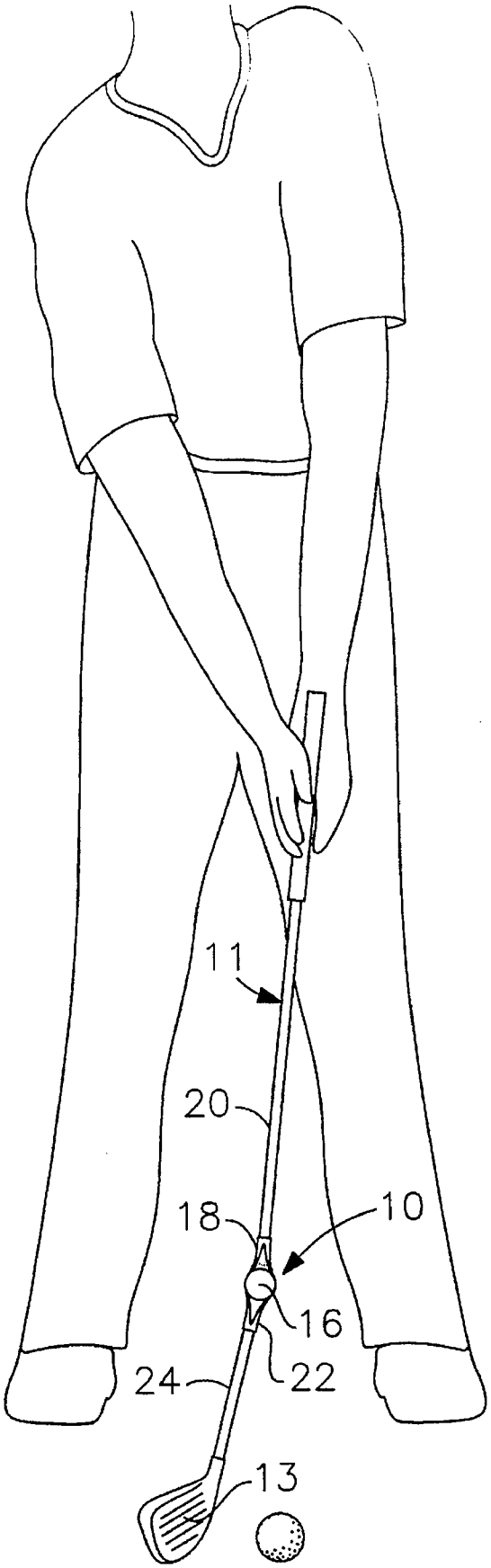
FIG. 5 is a perspective view depicting a golfer addressing a ball when the novel device is in a first position of adjustment.

More particularly, proximal part 12 includes a sleeve or hosel 18 that slideably receives the distal end of a proximal part 20 of a golf club shaft 11 (see FIG. 5) and distal part 14 includes a similar sleeve or hosel 22 that slideably receives the proximal end of a distal part 24 of a golf club shaft. A suitable adhesive is employed to secure the respective parts of the shaft into their associated hosels. In a preferred embodiment, novel device 10 is installed about eight inches from the heel of clubhead 13, i.e., an existing club shaft is cut in two about eight inches above said heel.

Figure 2:
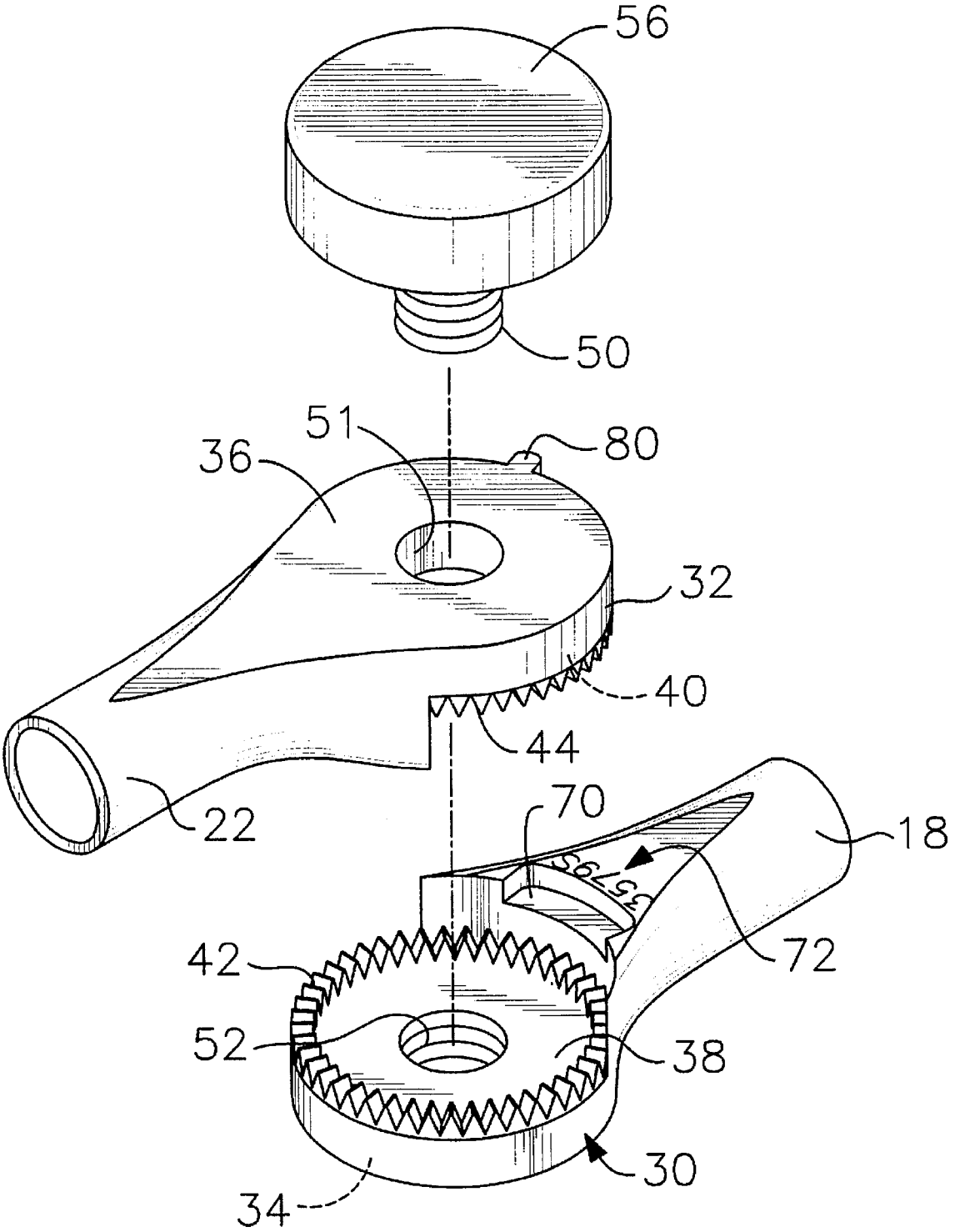
FIG. 2 is an exploded perspective view thereof.

As perhaps best understood in connection with the exploded perspective view of FIG. 2, middle part 16 includes a first toothed part or face plate 30 integral with proximal part 12, and a second toothed part or face plate 32 integral with distal part 14. Face plates 30, 32 each have a circular configuration; they include respective flat outer surfaces 34, 36 and respective inner surfaces 38, 40. A plurality of truncate, radially disposed teeth 42, 44 are formed in a peripheral edge of respective inner surfaces 38, 40; the teeth formed in the respective face plates interlock with their counterparts formed in the opposing face plate. The pitch of the teeth, in a preferred embodiment, is 8° so that each relative rotational adjustment between said face plates provides an 8° rotation therebetween. Thus, the respective proximal and distal parts of said shaft are disposable into differing angular relations to one another, in eight degree increments. Accordingly, the respective longitudinal axes of proximal and distal parts 20 and 24 of shaft 11 are positionable with respect to one another in said 8° increments.

Interlocking of said face plates in abutting relation to one another is achieved by any suitable releasable fastening means. The preferred fastening means is a screw 50 that extends through central bore 51 formed in face plate 32 and that screwthreadedly engages internally threaded bore 52 formed in the center of face plate 30. Screw 50 is advantageously provided with a large head 56 that facilitates its turning, said head being knurled, fluted, scored or otherwise provided with a friction-enhancing surface about its periphery.

Figure 3:
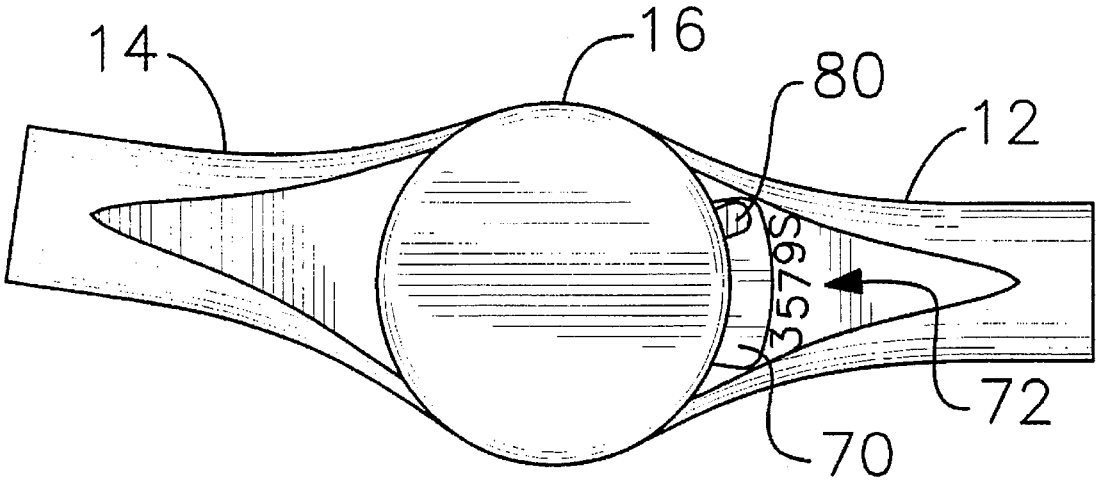
FIG. 3 is a top plan view thereof.
Figure 4:
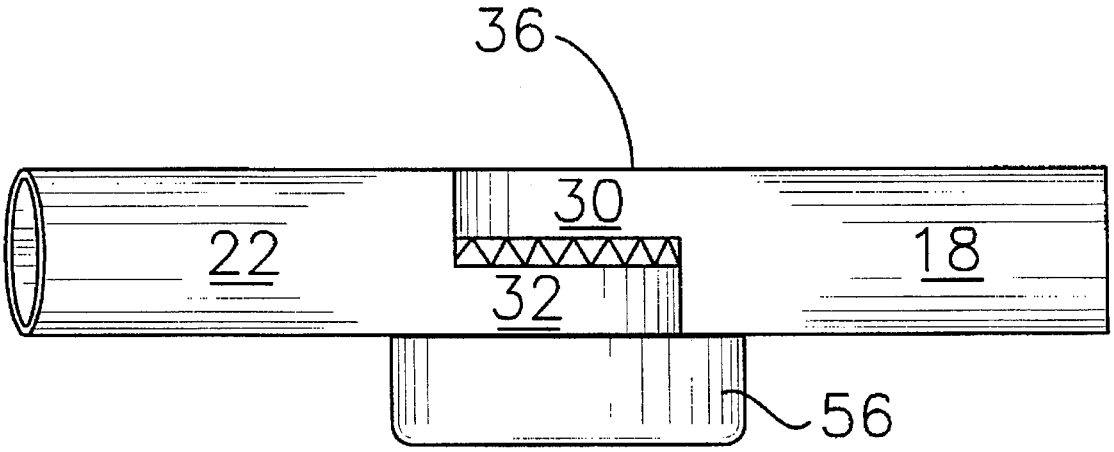
FIG. 4 is a side elevational view thereof.

An arcuate recess 70 (FIGS. 2 and 3) is formed in hosel 18 of proximal part 12, contiguous to face plate 30, and an indicia means 72 is imprinted on said hosel in closely spaced relation to said recess. In a preferred embodiment, indicia means 72 includes the following notation: 3 5 7 9 S, as indicated in FIGS. 2 and 3. A rigid, radially extending projection 80 is formed in a peripheral edge of face plate 32, and said projection is received within said recess 70 when the proximal and distal parts 12, 14 of the novel device are interconnected to one another.

Figure 6:
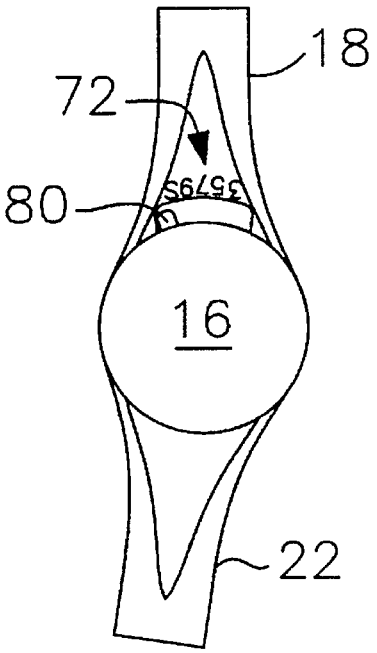
FIG. 6 is a side elevational view of the novel device when in said first position of adjustment.
Figure 7:
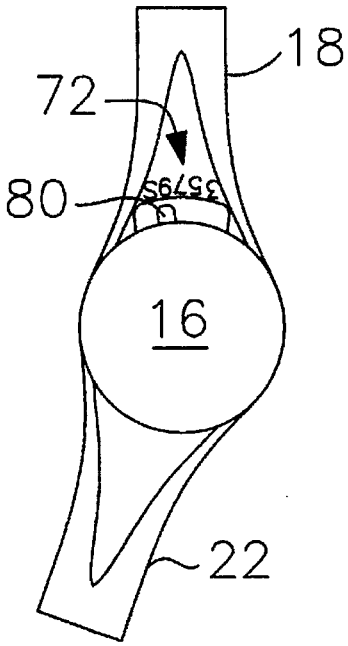
FIG. 7 is a side elevational view of the novel device when in a second position of adjustment.
Figure 8:
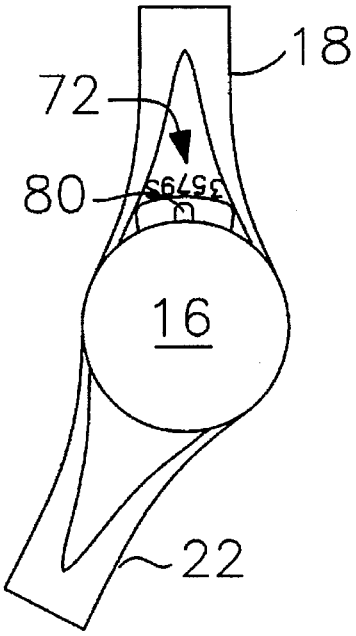
FIG. 8 is a side elevational view of the novel device when in a third position of adjustment.
Figure 9:
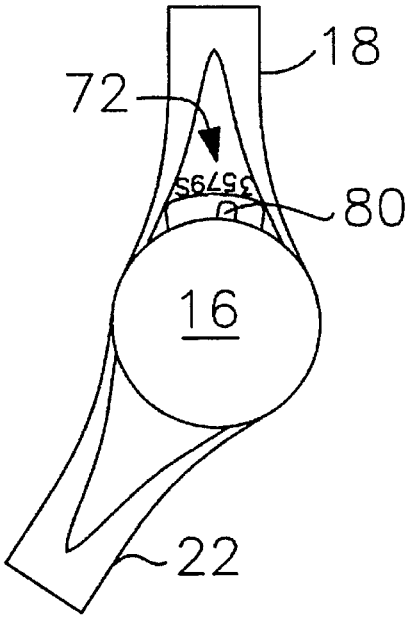
FIG. 9 is a side elevational view of the novel device when in a fourth position of adjustment.
Figure 10:
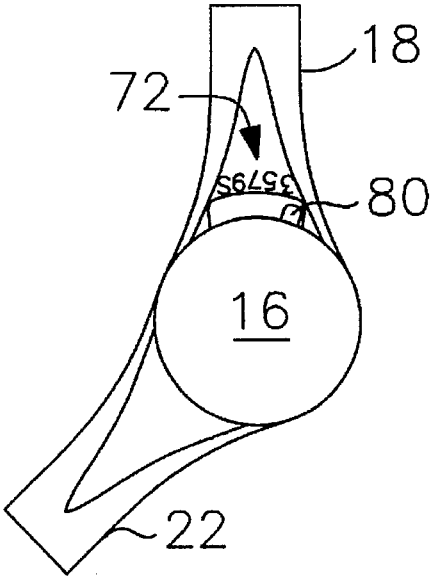
FIG. 10 is a side elevational view of the novel device when in a fifth position of adjustment.

In an exemplary embodiment of the invention, clubhead 13 is a 64° sand wedge. When projection 80 is in registration with indicia means S, as indicated in FIG. 6, the longitudinal axis of the distal part 24 of shaft 11 is positioned at an 8° angle relative to the longitudinal axis of the proximal part 20 of said shaft; this results in an 8° degree delofting of the clubhead face, i.e., the lofting is 56°, which is the normal sand wedge loft. To change the loft to 48°, which is a nine iron loft, screw 50 is loosened and face plates 30 and 32 are rotated eight degrees with respect to one another, and said screw is retightened. This results in pointer 80 pointing at indicia "9," (see FIG. 7) which indicates the loft of the clubhead is now equal to that of a 9 iron, i.e., 48°. Another one tooth rotation changes the loft to 40°, which is the loft for a 7 iron, and pointer 80 will indicate such (see FIG. 8). FIGS. 9 and 10 show the settings for a 5 iron (32° loft) and a 3 iron (24° loft), respectively.

As mentioned earlier, any quick release means that facilitates repositioning of the faceplates is within the scope of this invention, i.e., screw 50 having large head 56 is merely the preferred embodiment of the quick release means. Those of ordinary skill in the mechanical arts will know alternative ways of accomplishing the same thing by other, equivalent means, and it would unduly lengthen this disclosure to set forth such alternative means.

With each decrease in loft, an increase in angular momentum is achieved, i.e., the 3 iron setting produces the most angular momentum. Advantageously, when the Angle Iron (trademark) is set at the 3 iron position, the angular momentum generated teaches the golfer to release the club through impact, thereby eliminating the golfer's "slice."

Device 10 develops power, stops slicing, and promotes timing as will become apparent to those who train with it.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for pivotally interconnecting proximal and distal parts of a golf club shaft that has been cut into a proximal and a distal part, said shaft having a clubhead at the distal end of said distal part, comprising:

a proximal part of said device having a hosel for slideably receiving a distal end of said proximal part of said golf club shaft;

a distal part of said device having a hosel for slideably receiving a proximal part of said distal part of said golf club shaft;

a middle part of said device for interconnecting to one another said proximal and distal parts of said device in a plurality of angular positions with respect to one another;

a recess formed in an external surface of one of said proximal or distal parts of said device;

an indicia means imprinted upon said external surface in juxtaposition with said recess;

a pointer means integrally connected with the other of said proximal or distal parts and positioned within said recess so that said pointer means indicates a particular indicia when said proximal and distal parts of said device are rotationally positioned with respect to one another; and means for releasably interlocking said proximal part and said distal part of said device to one another in a preselected angular position selected from said plurality of angular positions;

whereby rotational adjustment of said proximal and distal parts of said device with respect to one another changes an angular relation between respective longitudinal axes of said proximal and distal parts of said golf club shaft and also changes the loft of said clubhead.

2. The device of claim 1, wherein said middle part includes a first face plate integral with said proximal part of said device and a second face plate integral with said distal part of said device.

3. The device of claim 2, wherein said means for releasably interlocking said proximal and distal parts of said device includes a first plurality of teeth formed in said first face plate integral with said proximal part of said device and a second plurality of teeth formed in said second face plate integral with said distal part of said device, said first and second plurality of teeth being formed in respective inner surfaces of said first and second face plates.

4. The device of claim 3, wherein each tooth of said first and second plurality of teeth is radially disposed with respect to a center of the face plate within which it is formed and wherein said plurality of teeth are formed in respective peripheries of their respective face plates.

5. The device of claim 3, further comprising a central bore formed in each of said face plates, at least one of said central bores being internally threaded.

6. The device of claim 4, further comprising an externally threaded screw for screw threaded engagement with said internal threads of said at least one central bore so that tightening said screw locks said face plates into a preselected rotational position with respect to one another and so that untightening said screw enables rotational repositioning of said face plates with respect to one another.

7. The device of claim 1, wherein said pointer means is a radially outwardly projecting protrusion formed in a peripheral edge of a preselected face plate.

* * * * *

UNITED STATES PATENT AND TRADEMARK OFFICE

CERTIFICATE OF CORRECTION

PATENT NO. : 5,634,857
DATED : June 3, 1997
INVENTOR(S) : Richard L. Bradshaw

It is certified that error appears in the above-identified patent and that said Letters Patent is hereby corrected as shown below:

Title page, item [19], delete the words --et al--.

Title page, item [76], the sole inventor should be --Richard L. Bradshaw, 18911 Edinborough Way, Tampa, Fla. 33647--.

Signed and Sealed this

Tenth Day of February, 1998

Bruce Lehman

*Attest:*

BRUCE LEHMAN

*Attesting Officer*

*Commissioner of Patents and Trademarks*